US009480890B2

(12) United States Patent
Matsunaga et al.

(10) Patent No.: US 9,480,890 B2
(45) Date of Patent: Nov. 1, 2016

(54) GOLF CLUB

(71) Applicant: Dunlop Sports Co., Ltd., Kobe-shi, Hyogo (JP)

(72) Inventors: Kiyofumi Matsunaga, Kobe (JP); Naruhiro Mizutani, Kobe (JP)

(73) Assignee: DUNLOP SPORTS CO. LTD., Kobe-Shi (JP)

( * ) Notice: Subject to any disclaimer, the term of this patent is extended or adjusted under 35 U.S.C. 154(b) by 218 days.

(21) Appl. No.: 14/311,886

(22) Filed: Jun. 23, 2014

(65) Prior Publication Data

US 2015/0011327 A1 Jan. 8, 2015

(30) Foreign Application Priority Data

Jul. 8, 2013 (JP) ..... 2013-142849

(51) Int. Cl.
*A63B 53/06* (2015.01)
*A63B 53/04* (2015.01)
*A63B 53/02* (2015.01)

(52) U.S. Cl.
CPC ..... *A63B 53/06* (2013.01); *A63B 53/0466* (2013.01); *A63B 2053/027* (2013.01); *A63B 2053/0433* (2013.01); *A63B 2053/0491* (2013.01)

(58) Field of Classification Search
CPC ..... A63B 2053/027; A63B 2053/0433; A63B 2053/0491; A63B 53/06
USPC ..... 473/341, 344, 345, 314, 328, 334–338
See application file for complete search history.

(56) References Cited

U.S. PATENT DOCUMENTS

| | | | | |
|---|---|---|---|---|
| 2006/0094526 | A1* | 5/2006 | Reed | A63B 53/0466 473/328 |
| 2011/0152000 | A1 | 6/2011 | Sargent et al. | |
| 2012/0122601 | A1 | 5/2012 | Beach et al. | |
| 2012/0172142 | A1 | 7/2012 | Yashiki | |
| 2012/0202615 | A1* | 8/2012 | Beach | A63B 53/06 473/338 |
| 2013/0090185 | A1* | 4/2013 | Boyd | A63B 53/06 473/337 |

FOREIGN PATENT DOCUMENTS

| | | |
|---|---|---|
| JP | 2001-204861 A | 7/2001 |
| JP | 2004-267460 A | 9/2004 |

* cited by examiner

*Primary Examiner* — Benjamin Layno
(74) *Attorney, Agent, or Firm* — Birch, Stewart, Kolasch & Birch, LLP

(57) ABSTRACT

A golf club 2 includes a head 4 and a shaft 6. A face 5 includes a sole s4 and a grounding member X1. The sole s4 includes a plurality of attaching portions r1. The grounding member X1 can be fixed to each of the plurality of attaching portions r1. A face angle can be varied depending on an attached position of the grounding member X1. Preferably, the golf club 2 further includes a non-grounding member X2. Preferably, the non-grounding member X2 can be fixed to each of the attaching portions r1. Preferably, attached position of the non-grounding member X2 does not influence the face angle.

20 Claims, 13 Drawing Sheets

GOLF CLUB

The present application claims priority on Patent Application No. 2013-142849 filed in JAPAN on Jul. 8, 2013, the entire contents of which are hereby incorporated by reference.

BACKGROUND OF THE INVENTION

1. Field of the Invention

The present invention relates to a golf club.

2. Description of the Related Art

A golf club including an adjusting function is proposed. The adjusting function can improve the compatibility of a golf club and a golfer.

US 2011/0152000 and US 2012/0122601 disclose golf clubs including a head and a shaft detachably attached to the head. In these golf clubs, the axis of a shaft hole of a sleeve is inclined to a hosel axis. The inclination of a shaft axis enables the adjustment of a loft angle, a lie angle, and a face angle. Furthermore, these U.S. gazettes disclose a mechanism capable of adjusting a face angle. Japanese Patent Application Laid-Open No. 2004-267460 discloses a golf club head including a bottom face to which a hook angle adjusting material is firmly fixed. Japanese Patent Application Laid-Open No. 2012-139403 (US2012/0172142) discloses a golf club including a head cavity body, a head weight, a grip cavity body, and a grip weight.

SUMMARY OF THE INVENTION

A face angle adjusting mechanism capable of corresponding to various sole shapes is preferable. A degree of freedom of adjustment is preferably high. It is an object of the present invention to provide a golf club including an improved face angle adjusting mechanism.

A preferable golf club includes a head and a shaft. The head includes a sole and a grounding member. The sole includes a plurality of attaching portions. The grounding member is detachably attached to any of the plurality of attaching portions. A face angle can be varied depending on an attached position of the grounding member.

Preferably, the golf club further includes a non-grounding member. Preferably, the non-grounding member is attachable and detachable to from each of the attaching portions. Preferably, an attached position of the non-grounding member does not influence the face angle.

Preferably, each of the plurality of attaching portions is a recess. Preferably, the recess can regulate rotation of the grounding member. Preferably, the recess can regulate rotation of the non-grounding member.

Preferably, the non-grounding member is attached to the attaching portion to which the grounding member is not attached.

Preferably, a weight of the grounding member is substantially equal to that of the non-grounding member.

A center of gravity of the head may move with movement of the grounding member. In this case, preferably, the golf club can be adjusted so that a center of gravity of the head moves to a back side as the face angle is opened.

DESCRIPTION OF THE PREFERRED EMBODIMENTS

The present invention will be described below in detail based on preferred embodiments with appropriate reference to the drawings.

Figure 1:
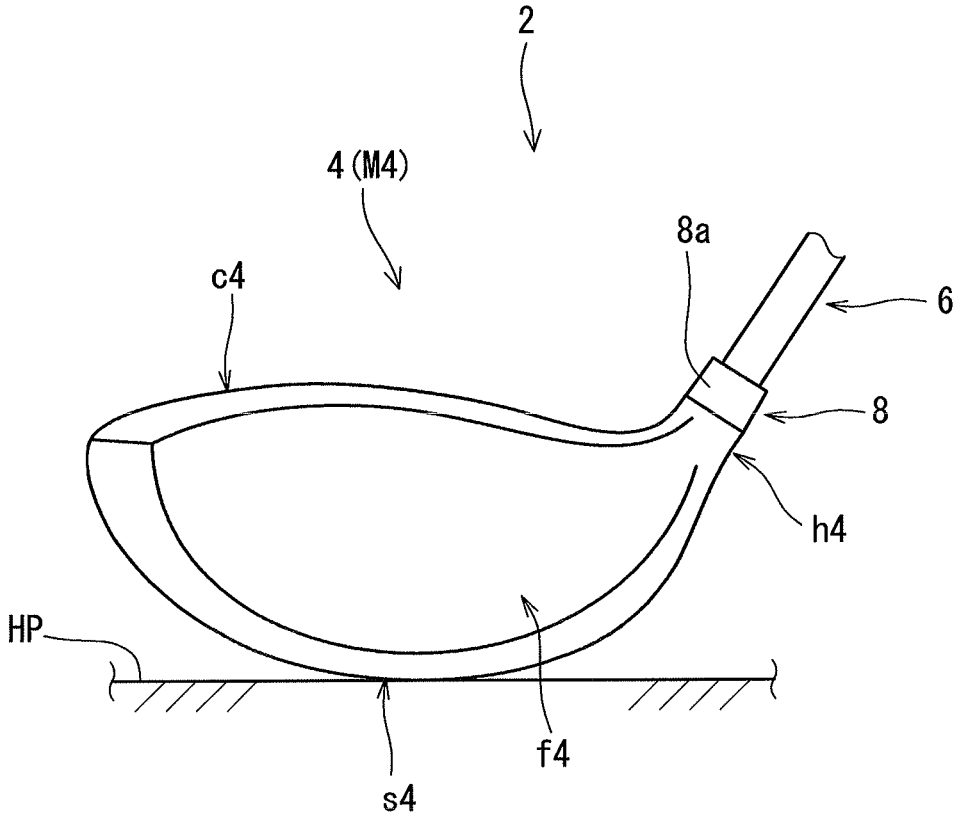
FIG. 1 shows a golf club according to a first embodiment of the present invention.
Figure 2:
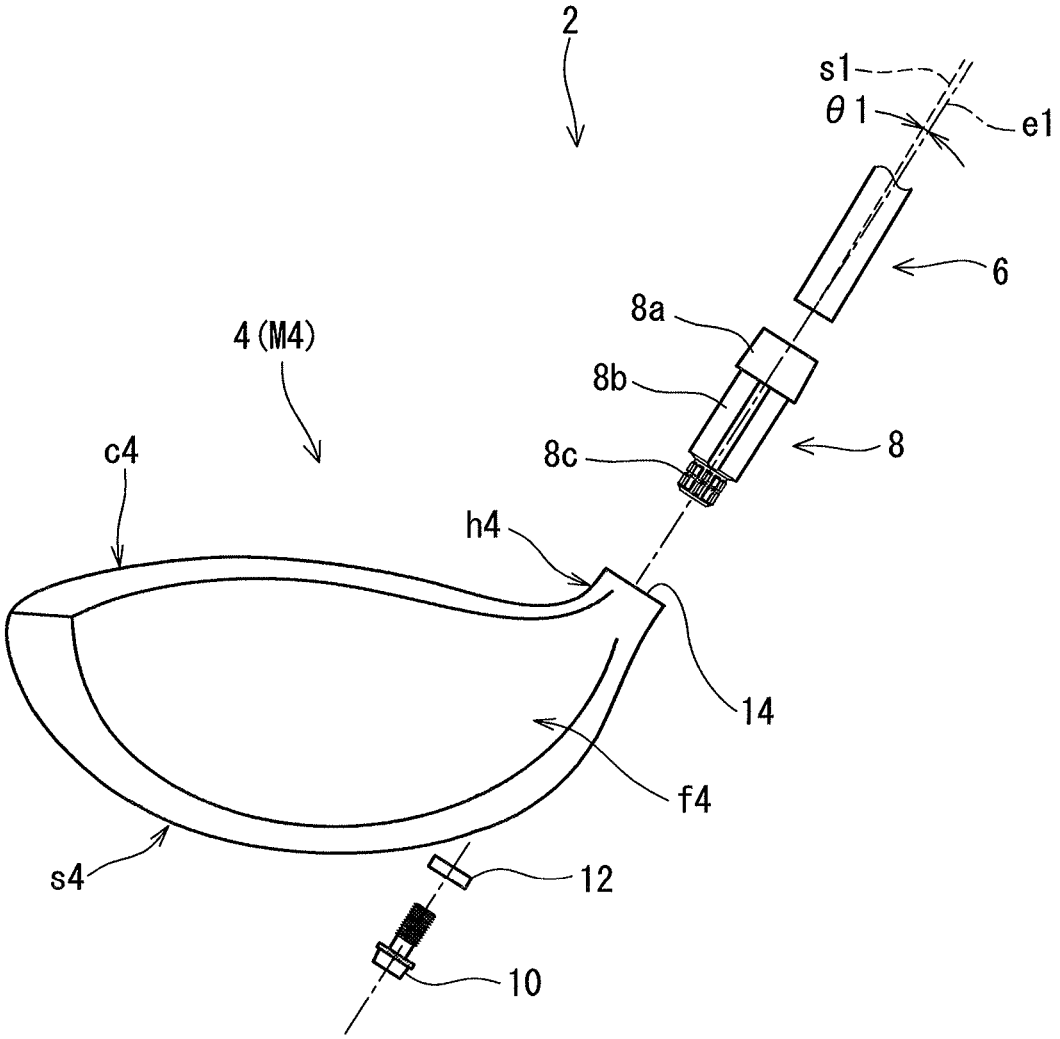
FIG. 2 is an exploded view of FIG. 1.

FIG. 1 shows a golf club 2 according to an embodiment of the present invention. FIG. 1 shows only a vicinity of a head of the golf club 2. FIG. 2 is an exploded view of the golf club 2.

The golf club 2 includes a head 4, a shaft 6, a sleeve 8, and a screw 10. The golf club 2 further includes a washer 12. The sleeve 8 is fixed to a tip portion of the shaft 6. The fixation is achieved by adhesion using a adhesive agent. A grip which is not shown in the figures is attached to a back end portion of the shaft 6.

The head 4 includes a body M4. As shown in FIGS. 1 and 2, the body M4 includes a crown c4, a sole s4, a face f4, and a hosel h4.

The head 4 of the embodiment is a wood type golf club. However, the type of the head 4 is not limited. Examples of the head 4 include a wood type head, a utility type head, a hybrid type head, an iron type head, and a putter head. Examples of the shaft 6 include a carbon shaft and a steel shaft.

The sleeve 8 is fixed to the head 4 by fastening the crew 10. Therefore, the shaft 6 is attached to the head 4. The sleeve 8 can be detached from the head 4 by loosening the screw 10. Therefore, the shaft 6 fixed to the sleeve 8 can also be detached from the head 4. Thus, the shaft 6 is detachably attached to the head 4.

Figure 3:
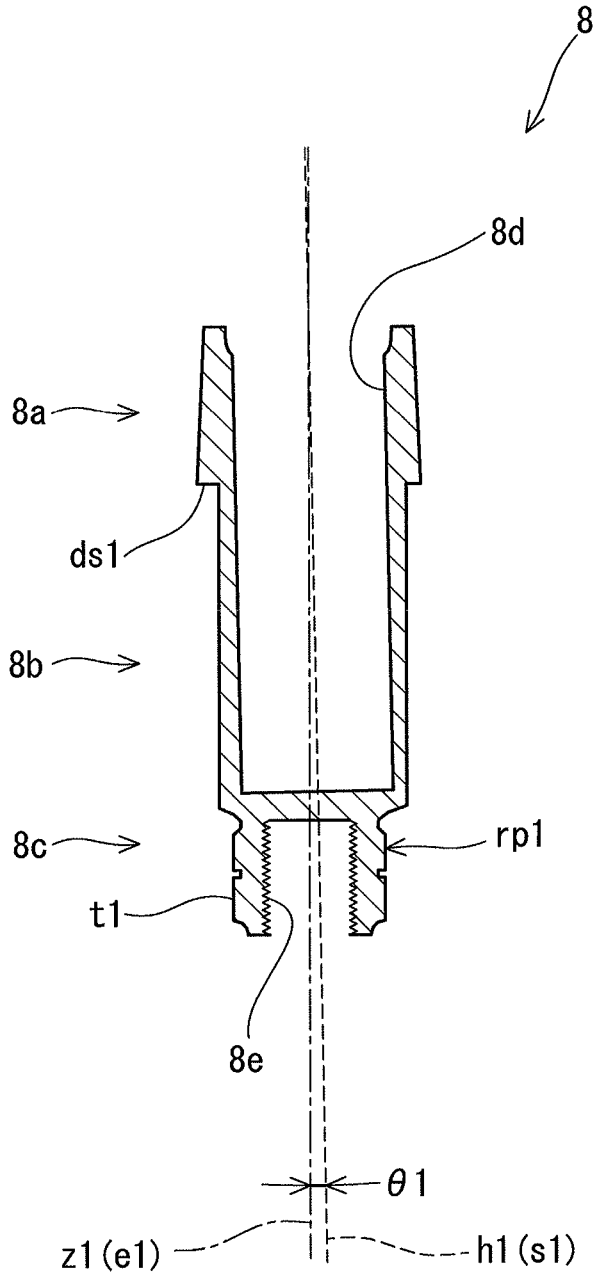
FIG. 3 is a cross-sectional view of a sleeve.
Figure 4:
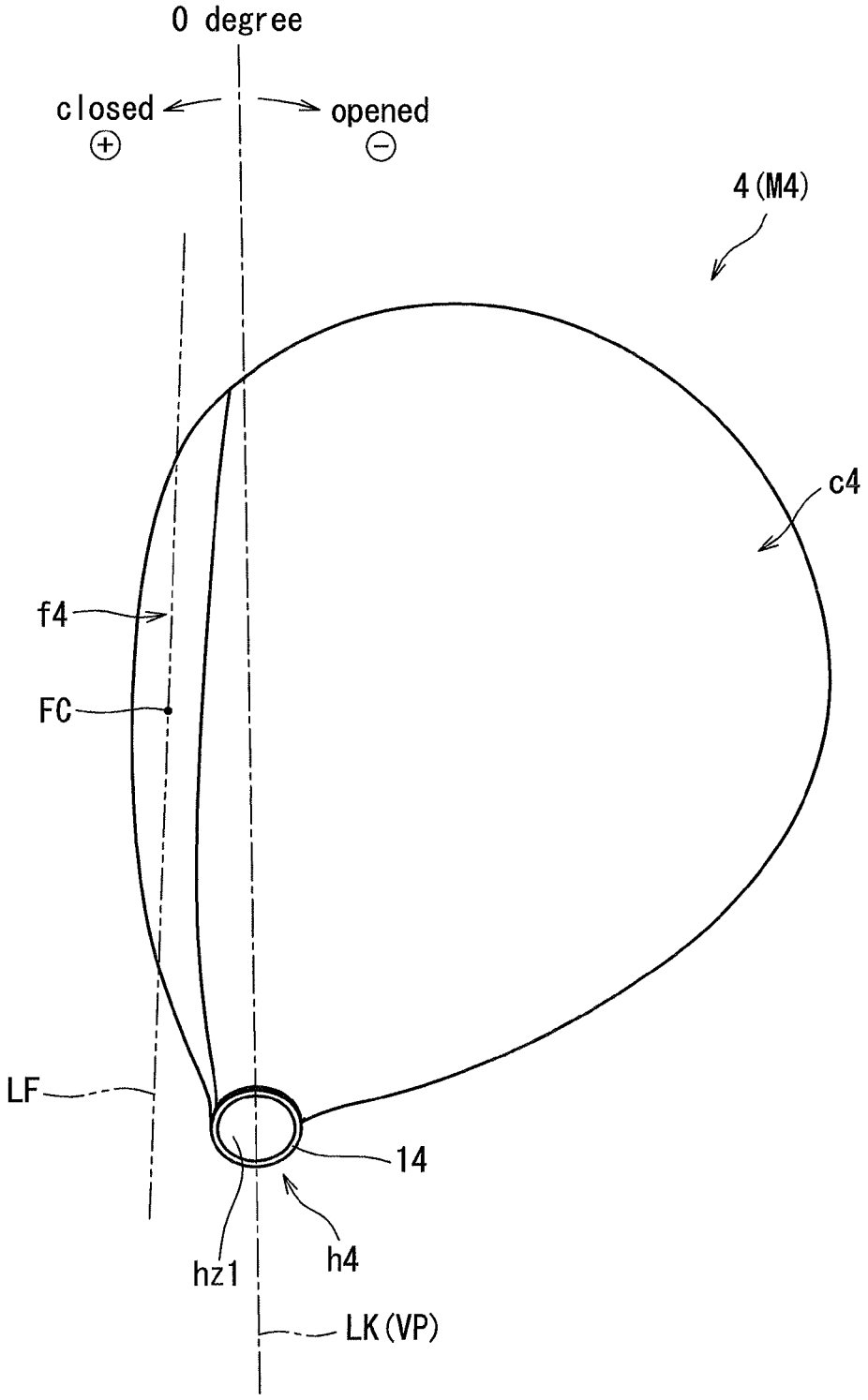
FIG. 4 is a plan view of a head.
Figure 5:
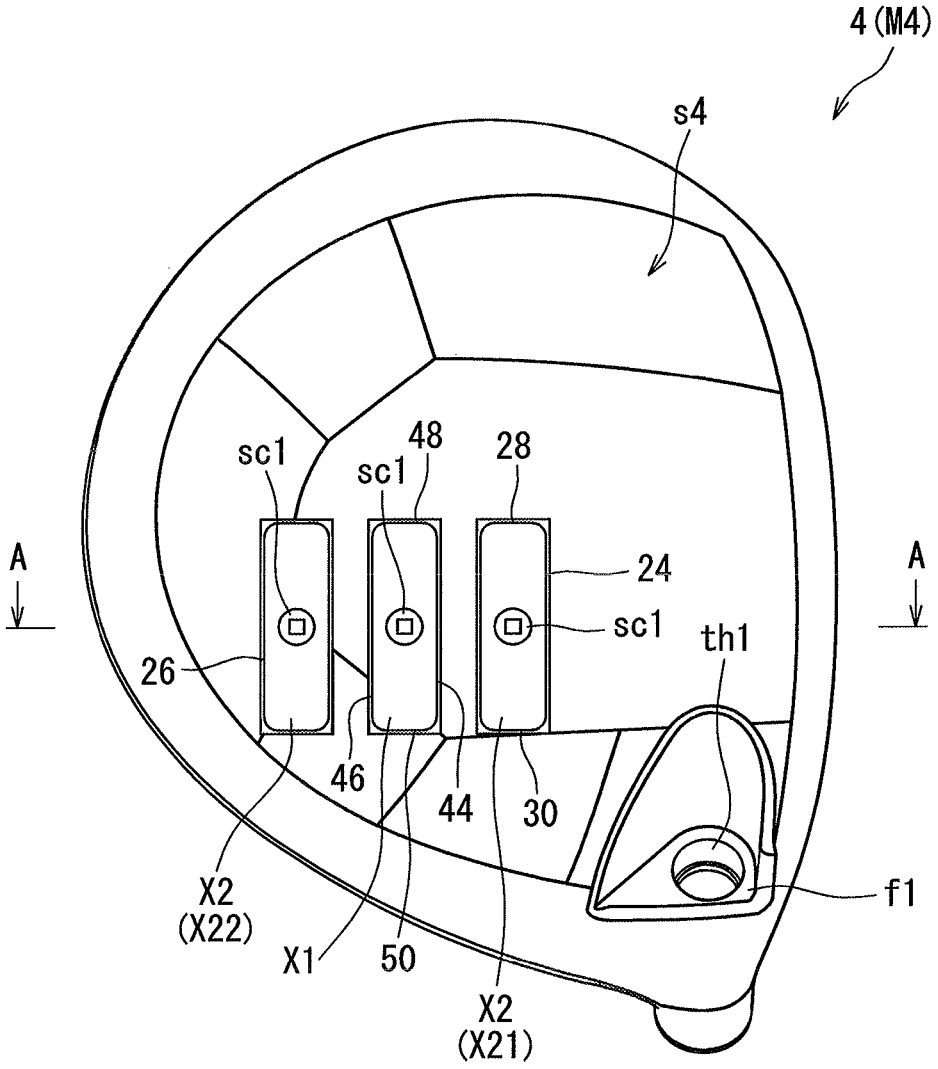
FIG. 5 is a bottom view of the head.
Figure 6:
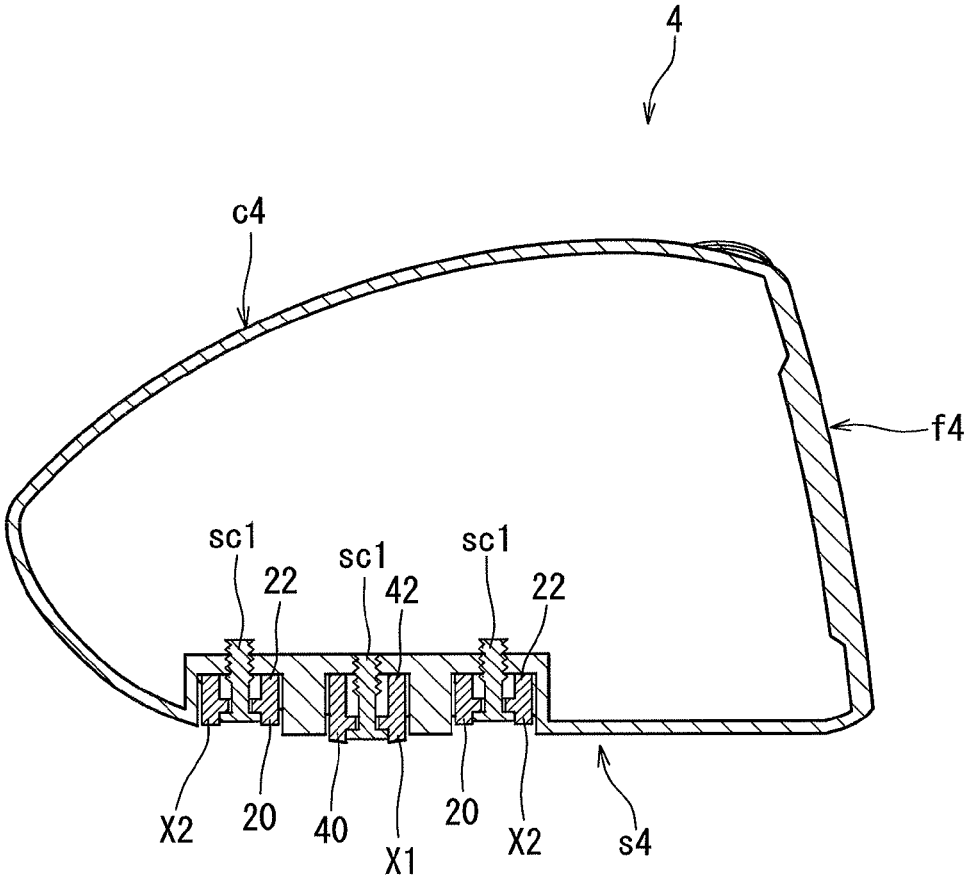
FIG. 6 is a cross-sectional view taken along line A-A of FIG. 5.

FIG. 3 is a cross-sectional view of the sleeve 8. FIG. 4 is a plan view of the head 4. FIG. 5 is a bottom view of the head 4. FIG. 6 is a cross-sectional view taken along line A-A of FIG. 5. As shown in FIG. 6, the head 4 is hollow.

The hosel h4 has a hosel hole hz1 (see FIG. 4) into which the sleeve B is inserted, and a through hole th1 (see FIG. 5) into which the screw 10 is inserted. The through hole th1 passes through a bottom portion of the hosel hole hz1.

The sleeve 8 includes an upper portion 8*a*, an intermediate portion 8*b*, and a lower portion 8*c*. A bump surface ds1 is formed on a boundary between the upper portion 8*a* and the intermediate portion 8*b*. The sleeve 8 has a shaft hole 8*d* and a screw hole 8*e*. The shaft hole 8*d* passes through the upper portion 8*a*, and leads to the intermediate portion 8*b*. The shaft hole 8*d* is opened to an upper side (a shaft side). The screw hole 8*e* is formed in the lower portion 8*c*. The screw hole 8*e* is opened to a lower side (a sole side).

As shown in FIG. 1, in a usable assembled state, the upper portion 8*a* is exposed to the outside. In the assembled state, the bump surface ds1 abuts on a hosel end face 14 of the head 4. As shown in FIG. 1, an outer diameter of a lower end of the upper portion 8*a* is substantially equal to an outer diameter of the hosel end face 14. In the assembled state, the upper portion 8*c* exhibits an appearance like a ferrule. In the assembled state, the intermediate portion 8*b* and the lower portion 8*c* are inserted into the hosel hole hz1. An outer surface of the intermediate portion 8*b* includes a circumferential surface. The circumferential surface is brought into surface contact with an inner surface of the hosel hole hz1. The hosel hole hz1 supports the intermediate portion 8*b* in the surface contact.

The lower portion 8*c* of the sleeve 8 includes a rotation-preventing portion rp1. A sectional shape of the rotation-preventing portion rp1 is a non-circular form in the embodiment, the rotation-preventing portion rp1 includes a plurality of projections t1. The projections t1 are outwardly projected in the radial direction. The plurality of projections t1 are disposed at equal intervals in a circumferential direction.

The rotation-preventing portion rp1 is engaged with a rotation-preventing portion (not shown) provided on the head 4. Although not shown in the drawings, a plurality of recesses are formed in the rotation-preventing portion of the head 4. The plurality of recesses are disposed at equal intervals in the circumferential direction. A shape of the recess corresponds to that of the projection t1 described above. Each of the projections t1 is engaged with the corresponding recess. The relative rotation of the head 4 and the sleeve 8 is prevented by the engagement.

As shown in FIG. 3, a center axis line h1 of the shaft hole 8*d* is inclined to a center axis line z1 of the sleeve 8. An angle θ1 shown in FIG. 3 is an angle between the axis line h1 and the axis line z1. An axis line s1 of the shaft 6 is inclined to an axis line e1 of the hosed hole due to the inclination of the center axis line h1. The inclination angle is also θ1.

The sleeve 8 can be fixed to the head 4 at a plurality of circumferential positions. The direction of the axis line s1 of the shaft 6 to the head 4 can be varied depending on the plurality of circumferential positions and the angle θ1. A face angle, a lie angle, and a real loft angle can be varied by the circumferential position of the sleeve 8. The face angle, the lie angle, and the real loft angle can be adjusted by selecting the circumferential position of the sleeve 8. In the adjustment, the face angle, the lie angle, and the real loft angle are interlocked with each other.

The prevention of coming off of the sleeve 8 is achieved by screw connection of the sleeve to and the screw 10. In the assembled state, the screw 10 is inserted into the through hole th1, and connected to the screw hole 8*e* of the sleeve 8 in a screwing manner. In the assembled state, a head portion of the screw 10 cannot pass through the through hole th1. The head portion of the screw 10 abuts on a lower surface f1 (see FIG. 5) of the head 4 with the washer 12 interposed between the head portion and the lower surface f1. The screw 10 produces an axial force in the abutment. The bump surface ds1 is pressed against the hosel end face 14 by the axial force. The movement of the sleeve 8 upward in the axial direction is prevented by the axial force. The fixation of the sleeve 8 in the axial direction is maintained by the screw 10.

As shown in FIG. 5, the head 4 includes a grounding member X1 and a non-grounding member X2. In a face angle measurement state to be described later, the grounding member X1 is brought into contact with a level surface HP. On the other hand, in a face angle measurement state to be described later, the non-grounding member X2 is not brought into contact with the level surface HP. Needless to say, in an actual use situation, the non-grounding member X2 may be brought into contact with grass or the like.

The head 4 includes a grounding member X1. The number of the grounding members X1 may be plural. The head 4 includes a plurality of non-grounding members X2. The number of the non-grounding members X2 may be 1. As described later, the non-grounding member X2 may not be present.

In the embodiment, the head 4 includes two non-grounding members X2. In the embodiment of FIG. 5, a first non-grounding member X21 is disposed on the face side of the grounding member X1. Meanwhile, a second non-grounding member X22 is disposed on the back side of the grounding member X1.

The grounding member X1 is fixed to the sole s4 by a screw sc1 (see FIG. 6), respectively. The grounding member X1 is detachably attached. The grounding member X1 can be detached from the sole s4 by releasing the screw connection. The grounding member X1 can be attached to the sole s4 by making the screw connection.

The two non-grounding members X2 are fixed to the sole s4 by the screws sc1 (see FIG. 6). These non-grounding members X2 are detachably attached. The non-grounding members X2 can be detached from the sole s4 by releasing the screw connection. The non-grounding members X2 can be attached to the sole 34 by making the screw connection.

Figure 7:
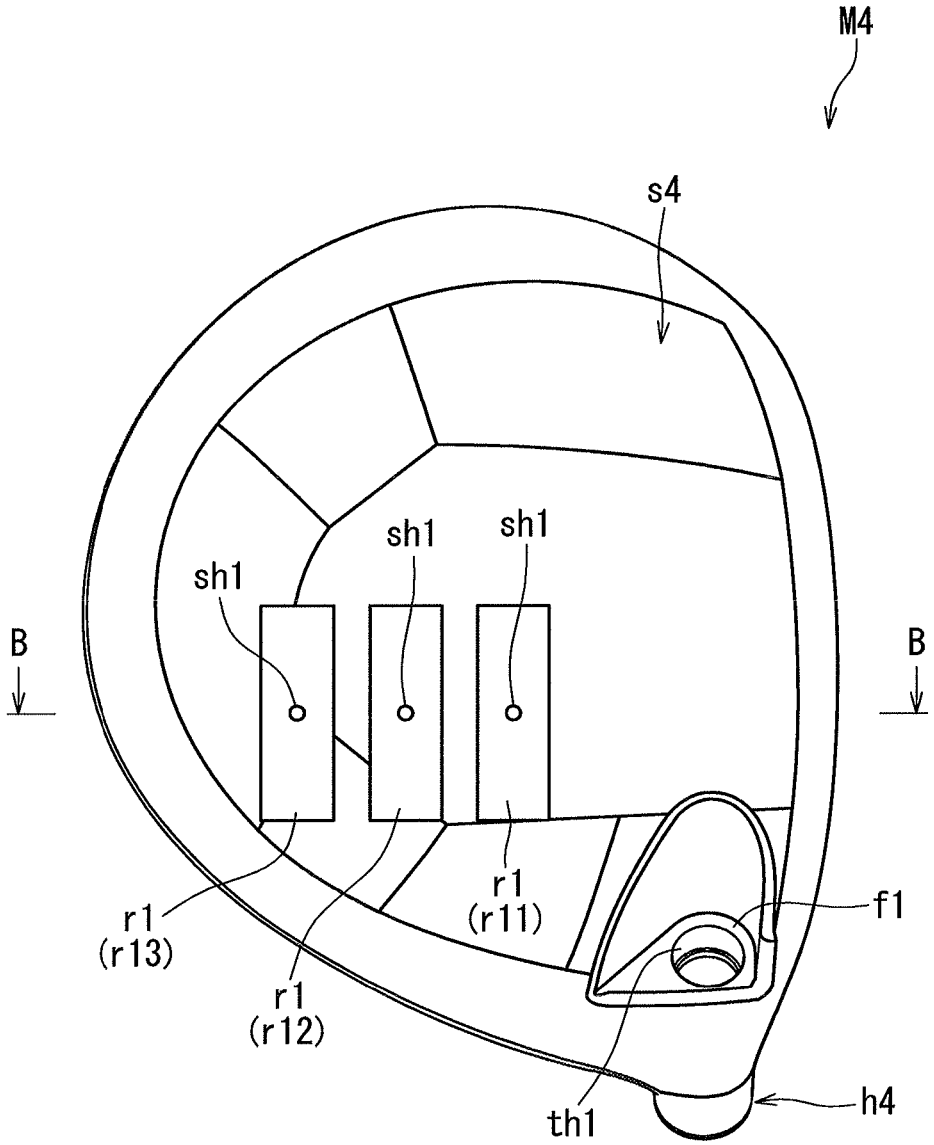
FIG. 7 is a bottom view of a head body.
Figure 8:
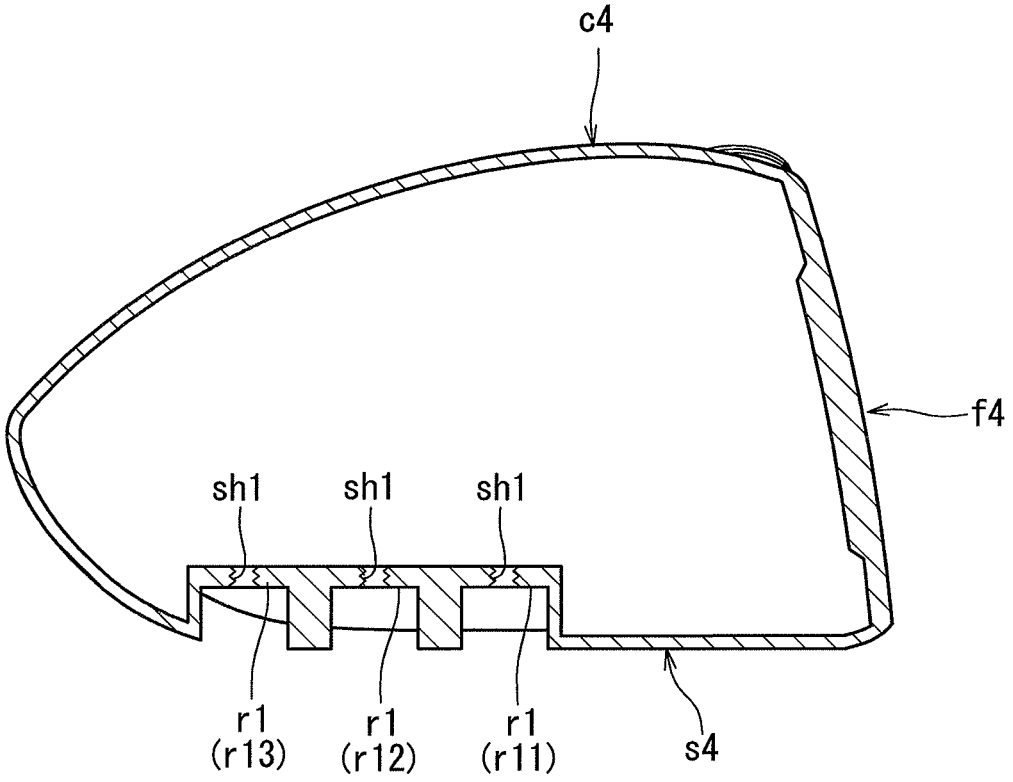
FIG. 8 is a cross-sectional view taken along line B-B of FIG. 7.

FIG. 7 is a bottom view of the head 4 in a state where the grounding member X1 and the non-grounding member X2 are detached. FIG. 8 is a cross-sectional view taken along line B-B of FIG. 7.

As shown in FIG. 7, the sole s4 includes an attaching portion r1. In the embodiment, a plurality of attaching portions r1 are provided. In the embodiment, three attaching portions r1 are provided. The attaching portion r1 may not be present. The number of the attaching portions r1 may be equal to or greater than 3.

As shown in FIG. 7, first attaching portion r11 is positioned on the most face side. A third attaching portion r13 is positioned on the most back side. A second attaching portion r12 is positioned between the attaching portion r11 and the attaching portion r13. The plurality of attaching portions r1 are disposed in different positions in a face-back direction.

As shown in FIG. 8, the attaching portion r11 is a recess. Similarly, the attaching portion r12 is a recess. Similarly, the attaching portion r13 is a recess. All of the attaching portions r1 are recesses. The attaching portion r1 may not be a recess. For example, the attaching portion r1 may be a plane having a screw hole.

As shown in FIG. 7, all of the attaching portions r1 have the same planar view shape. In the embodiment, the planar view shape is a quadrangle (rectangle).

As shown in FIGS. 7 and 8, the attaching portion r11 has a screw hole sh1. Similarly, the attaching portion r12 has a screw hole sh1. Similarly, the attaching portion r13 has a screw hole sh1. All of the attaching portions r1 have screw holes sh1. The screw hole sh1 is formed in a bottom face of the attaching portion r1. As shown in FIG. 8, the screw hole sh1 passes through the bottom face of the attaching portion r1, and leads to a hollow portion of the head 4. The screw hole sh1 includes a female screw. Screw connection is achieved between the female screw and a male screw of the screw sc1 (see FIG. 6).

As shown in FIG. 6, the grounding member X1 has a height greater than a depth of the recess r1. The grounding member X1 is projected in the sole s4. On the other hand, the non-grounding member X2 has a height equal to or less than the depth of the recess r1. The non-grounding member X2 is not projected in the sole s4.

Figure 9A:
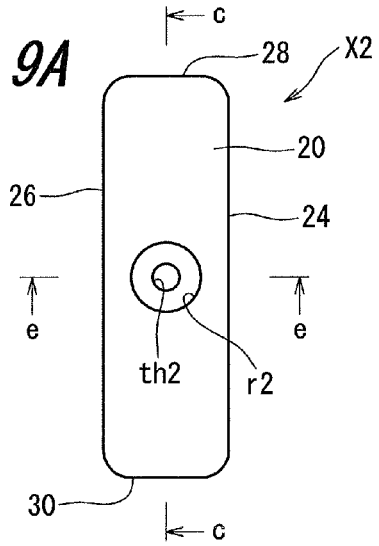
FIG. 9A is a plan view of a non-grounding member.
Figure 9D:
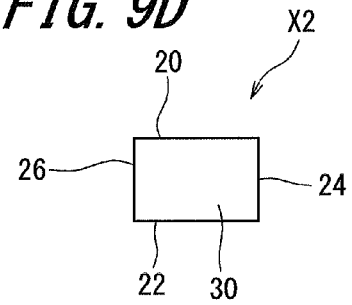
FIG. 9D is a front view of the non-grounding member.
Figure 9B:
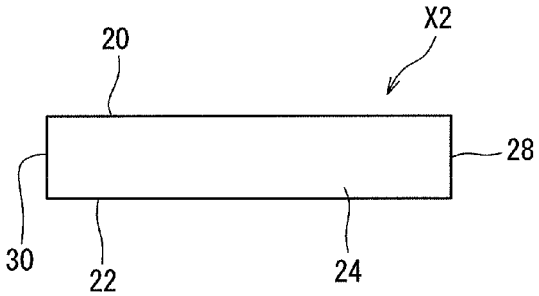
FIG. 9B is a side view of the non-grounding member.
Figure 9E:
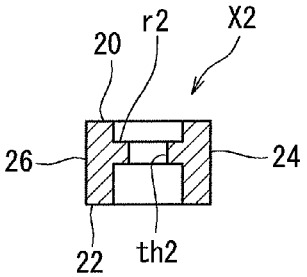
FIG. 9E is a cross-sectional view taken along line e-e of FIG. 9A.
Figure 9C:
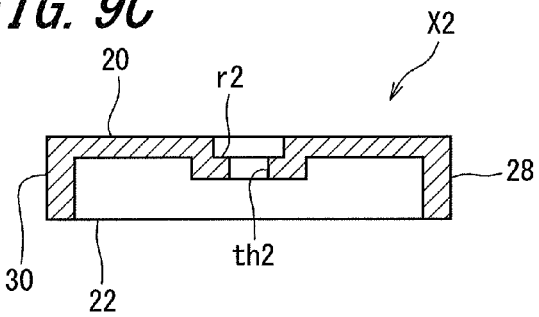
FIG. 9C is a cross-sectional view taken along line c-c of FIG. 9A.

FIG. 9A is a plan view of the non-grounding member X2. FIG. 9B is a side view of the non-grounding member X2. FIG. 9C is a cross-sectional view taken along line c-c of FIG. 9A. FIG. 9D is a front view of the non-grounding member X2. FIG. 9E is a cross-sectional view taken along line e-e of FIG. 9A.

The non-grounding member X2 includes an upper surface 20, a lower surface 22, a first side surface 24, a second side surface 26, a third side surface 28, and a fourth side surface 30. FIG. 9E is upside down to FIG. 6. In FIG. 5, the upper surface 20 is positioned on the lower side. The upper surface 20 is an exposed surface in the sole s4. The lower surface 22 abuts on the bottom face of the attaching portion (recess) r1.

As shown in FIG. 9A, in the plan view, the non-grounding member X2 has a substantially rectangular shape. The substantially rectangular shape means that the roundness of each of four corner portions is accepted. Each of the first side surface 24 and the second side surface 26 forms long side in the substantially rectangular shape. The first side surface 24 and the second side surface 26 are parallel to each other. Each of the third side surface 28 and the fourth side surface 30 forms short side in the substantially rectangular shape. The third side surface 28 and the fourth side surface 30 are parallel to each other.

In an attached state, the first side surface 24 and the second side surface 26 abut on side surfaces of the attaching portion (recess) r1. The fixation of the non-grounding member X2 is ensured by the abutment. In FIGS. 5 and 6, a small clearance is present between each of the side surfaces 24 and 26 and the recess r1. However, in fact, the clearance is not present.

In the attached state, the third side surface 28 and the fourth side surface 30 abut on side surfaces of the attaching portion (recess) r1. The fixation of the non-grounding member X2 is ensured by the abutment. In FIG. 5, a small clearance is present between each of the side surfaces 28 and 30 and the recess r1. However, in fact, the clearance is not present.

In the plan view, the shape of the non-grounding member X2 corresponds to that of the attaching portion (recess) r1. The rotation of the non-grounding member X2 is prevented by the recess r1. The non-grounding member X2 cannot be rotated due to the recess r1. The recess r1 contributes to the fixation of the non-grounding member X2. The non-grounding member X2 is certainly fixed by the prevention of rotation caused by the recess r1 and the screwing.

As shown in FIGS. 9C and 9E, the non-grounding member X2 includes a hollow portion. The hollow portion opens at the lower surface 22. The weight saving of the non-grounding member X2 is achieved by the hollow portion. The hollow portion may not be present.

The non-grounding member X2 has a through hole th2 and a housing recess r2. The inner diameter of the through hole th2 is set so that a male screw portion of the screw sc1 can be inserted into the through hole th2. The inner diameter of the through hole th2 is set so that a head portion of the screw seal cannot be inserted into the through hole th2. In the connected state of FIG. 6, the male screw portion of the screw sc1 passes through the through hole th2, and is connected to the screw hole sh1. As shown in FIG. 6, the head portion of the screw sc1 is housed in the housing recess r2.

Figure 10A:
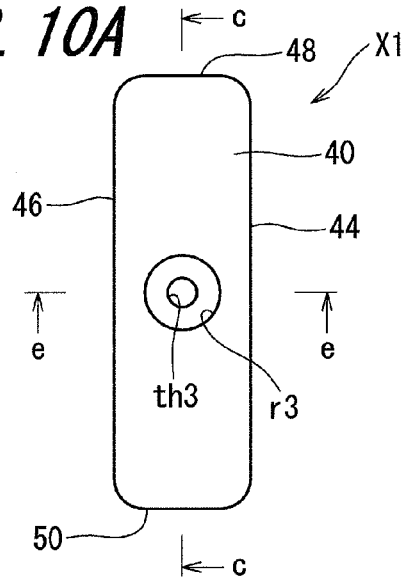
FIG. 10A is a plan view of a grounding member.
Figure 10D:
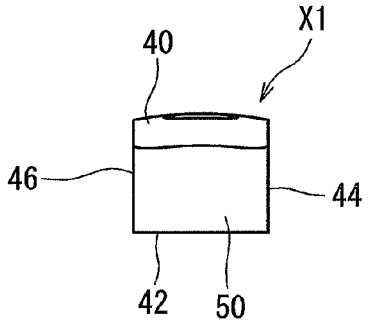
FIG. 10D is a front view of the grounding member.
Figure 10B:
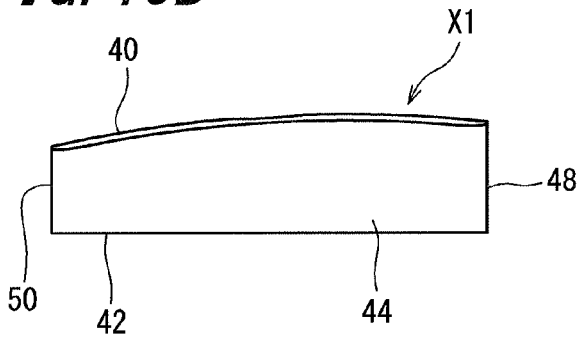
FIG. 10B is a side view of the grounding member.
Figure 10E:
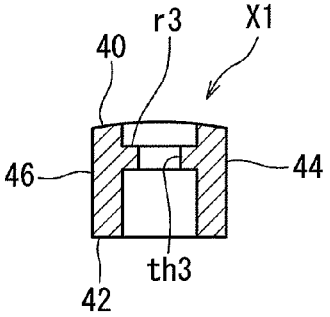
FIG. 10E is a cross-sectional view taken along line e-e of FIG. 10A.
Figure 10C:
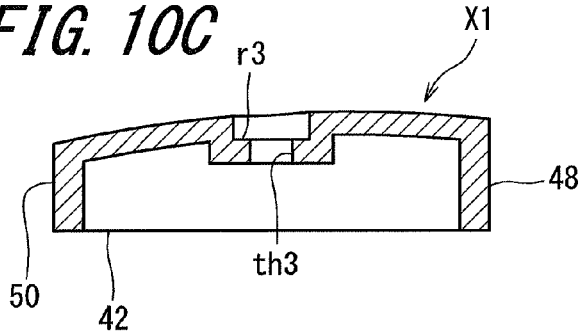
FIG. 10C is a cross-sectional view taken along line c-c of FIG. 10A.

FIG. 10A is a plan view of the grounding member X1. FIG. 10B is a side view of the grounding member X1. FIG. 10C is a cross-sectional view taken along line c-c of FIG. 10A. FIG. 10D is a front view of the grounding member X1. FIG. 10E is a cross-sectional view taken along line e-e of FIG. 10A.

The grounding member X1 includes an upper surface 40, a lower surface 42, a first side surface 44, a second side surface 46, a third side surface 48, and a fourth side surface 50. FIG. 10E is upside down to FIG. 6. In FIG. 6, the upper surface 40 is positioned on the lower side. The upper surface 40 is an exposed surface in the sole s4. The upper surface 40 is a grounding surface. The lower surface 42 abuts on the bottom face of the attaching portion (recess) r1.

As shown in FIG. 10A in the plan view, the grounding member X1 has a substantially rectangular shape. The substantially rectangular shape means that the roundness of each of four corner portions is accepted. Each of the first side surface 44 and the second side surface 46 forms long side in the substantially rectangular shape. The first side surface 44 and the second side surface 46 are parallel to each other. Each of the third side surface 48 and the fourth side surface 50 forms short side in the substantially rectangular shape. The third side surface 48 and the fourth side surface 50 are parallel to each other.

In an attached state, the first side surface 44 and the second side surface 46 abut on side surfaces of the attaching portion (recess) r1. The fixation of the grounding member X1 is ensured by the abutment. In FIGS. 5 and 6, a small clearance is present between each of the side surfaces 44 and 46 and the recess r1. However, in fact, the clearance is not present.

In the attached state, the third side surface 48 and the fourth side surface 50 abut on side surfaces of the attaching portion (recess) r1. The fixation of the grounding member X1 is ensured by the abutment. In FIG. 5, a small clearance is present between each of the side surfaces 48 and 50 and the recess r1. However, in fact, the clearance is not present.

In the plan view, the shape of the grounding member X1 corresponds to that of the attaching portion (recess) r1. The rotation of the grounding member X1 is prevented by the recess r1. The grounding member X1 cannot be rotated due to the recess r1. The recess r1 contributes to the fixation of the grounding member X1. The grounding member X1 is certainly fixed by the prevention of rotation caused by the recess r1, and the screwing.

As shown in FIGS. 10C and 10E, the grounding member X1 includes a hollow portion. The hollow portion opens at the lower surface 42. The weight saving of the grounding member X1 is achieved by the hollow portion. The hollow portion may not be present.

The grounding member X1 has a through hole th3 and a housing recess r3. The inner diameter of the through hole th3 is set so that a male screw portion of the screw sc1 can be inserted into the through hole th3. The inner diameter of the through hole th3 is set so that a head portion of the screw sc1 cannot be inserted into the through hole th3. In the connected state of FIG. 6, the male screw portion of the screw sc1 passes through the through hole th3, and is connected to the screw hole sh1. As shown in FIG. 6, the head portion of the screw sc1 is housed in the housing recess r3. In the face angle measurement state, the head portion of the screw sc1 is not grounded.

The upper surface 40 is also referred to as a grounding surface. The grounding surface 40 is a curved surface. The curved surface is a convex curved surface. That is, the grounding surface 40 is a curved surface convexed to the outside of the head 4. Stable grounding is enabled by the curved surface. The posture of the head 4 in address can be stabilized by forming the grounding surface 40 into the curved surface.

Figure 11A:
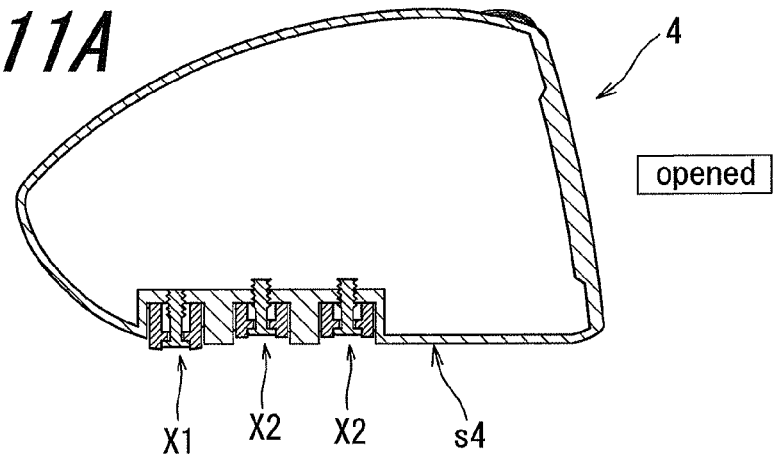
FIGS. 11A, 11B, and 11C describe a method for adjusting a face angle.
Figure 11B:
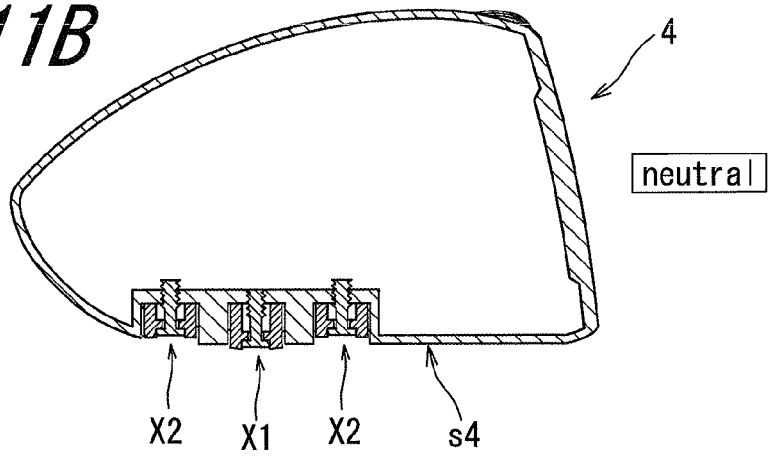
Figure 11C:
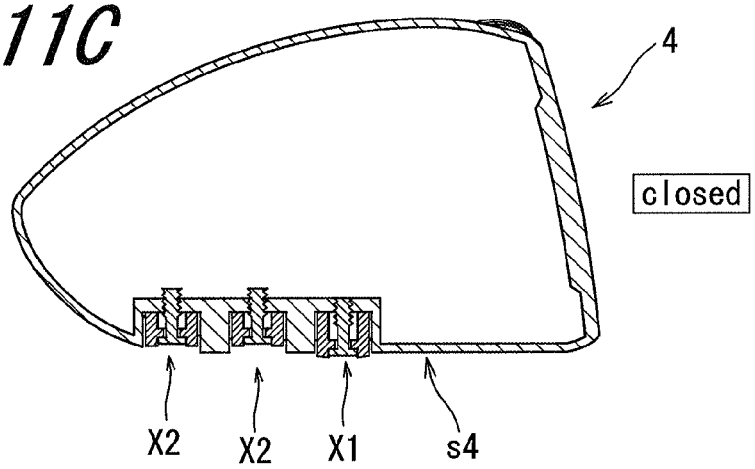

FIGS. 11A, 11B, and 11C are cross-sectional views for describing the adjustment of the face angle (a first adjusting method).

In the embodiment of FIG. 11A, the grounding member X1 is attached to the third attaching portion r13. The non-grounding member X2 is attached to each of the first attaching portion r11 and the second attaching portion r12.

In the embodiment of FIG. 11B, the grounding member X1 is attached to the second attaching portion r12. The non-grounding member X2 is attached to each of the first attaching portion r11 and the third attaching portion r13.

In the embodiment of FIG. 11C, the grounding member X1 is attached to the first attaching portion r11. The non-grounding member X2 is attached to each of the second attaching portion r12 and the third attaching portion r13.

In the embodiment, the face angle is adjusted in three stages. The face angle in FIG. 11A is opened as compared with that in FIG. 11B. If the sole s4 is grounded to address the golf club, the face of the head of FIG. 11A is apt to turn to the right as compared with that of FIG. 11B. The face angle in FIG. 11C is closed as compared with that in FIG. 11B. If the sole s4 is grounded to address the golf club, the face of the head of FIG. 11C is apt to turn to the left as compared with that of FIG. 11B.

The face angle can be adjusted in four stages, including the case where the grounding member X1 is not used. When the plurality of grounding members X1 having different heights are used, the face angle can be adjusted in more stages.

In the embodiment of FIGS. 11A, 11B, and 11C, the non-grounding members X2 are attached to all of the attaching portions r1 to which the grounding members X1 are not attached.

Figure 12A:
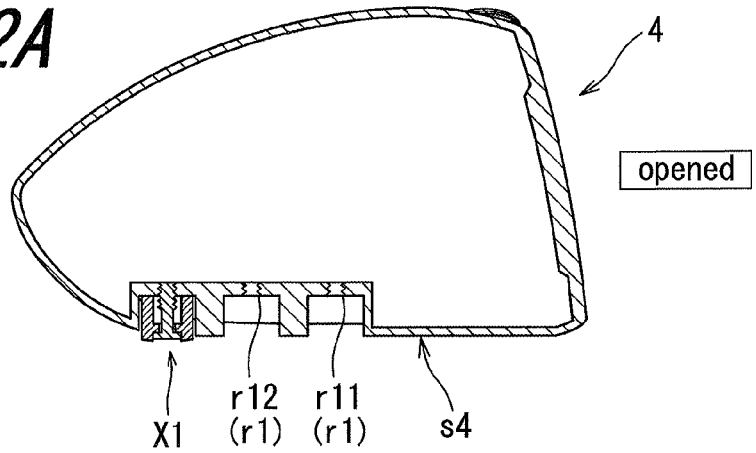
FIGS. 12A, 12B, and 12C describe another method for adjusting the face angle.
Figure 12B:
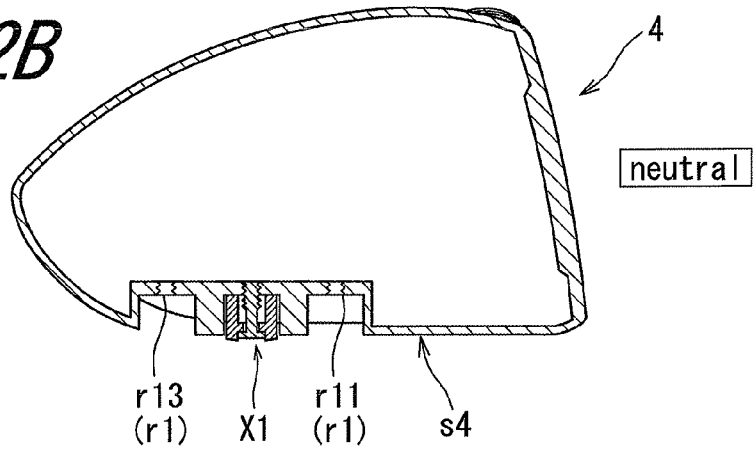
Figure 12C:
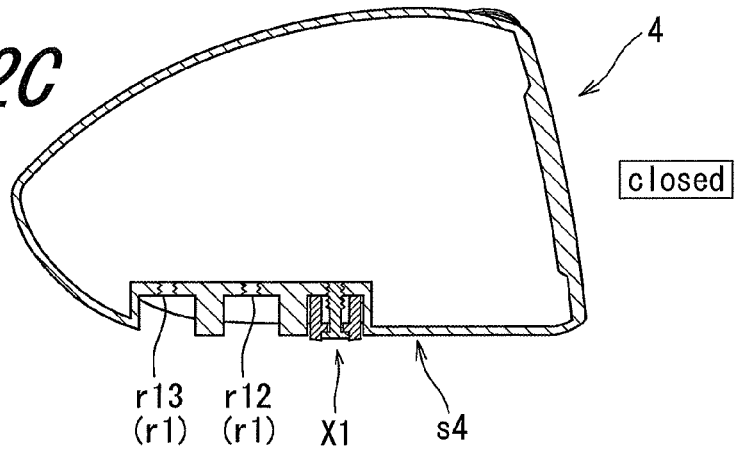

FIGS. 12A, 12B, and 12C are cross-sectional views for describing the adjustment of the face angle (second adjusting method.

In the embodiment of FIG. 12A, the grounding member X1 is attached to the third attaching portion r13. There is no non-grounding member X2 attached to any of the attaching portions r1.

In the embodiment of FIG. 12B, the grounding member X1 is attached to the second attaching portion r12. There is no non-grounding member X2 attached to any of the attaching portions r1.

In the embodiment of FIG. 12B, the grounding member X1 is attached to the first attaching portion r11. There is no non-grounding member X2 attached to any of the attaching portions r1.

Also in the embodiment, the face angle is adjusted in three stages. The face angle in FIG. 12A is opened as compared with that in FIG. 12B. In address in which the sole s4 is grounded, the face of the head of FIG. 12A is apt to turn to the right as compared with that of FIG. 12B. The face angle in FIG. 12C is closed as compared with that in FIG. 12B. In the address in which the sole s4 is grounded, the face of the head of FIG. 12C is apt to turn to the left as compared with that of FIG. 12B.

In a face angle measurement state to be described the grounded place of the head 4 is a front portion of the sole s4, and the grounding member X1. When the grounding member X1 moves, one grounded place moves. The face angle can be varied depending on the movement of the grounded place. In the embodiment, as the grounding member X1 moves to the back side, the face angle is opened. In other words, as the grounding member X1 moves to the face side, the face angle is closed.

In a face angle measurement state to be described later, the non-grounding member X2 is not grounded. Even if the non-grounding member X2 is attached to any of the attaching portions r1, the non-grounding member X2 does not influence the face angle. Therefore, the face angle of FIG. 11A is equal to that of FIG. 12A. The face angle of FIG. 11B is equal to that of FIG. 12B. The face angle of FIG. 110 is equal to that of FIG. 12C.

The non-grounding member X2 can suppress variation in the position of a center of gravity of the head 4. The grounding member X1 moves in the first adjusting method shown in FIGS. 11A, 11B, and 11C. Weight distribution in the head 4 is varied by the movement of the grounding member X1. However, the variation in the weight distribution is suppressed by the existence of the non-grounding member X2. As a result, the non-grounding member X2 can suppress the movement of the center of gravity of the head caused by the adjustment of the face angle.

Thus, the movement of the center of gravity of the head can be suppressed by the first adjusting method.

A foreign matter is apt to intrude into the recess r1. Examples of the foreign matter include soil, sand, and grass. The foreign matter is apt to remain in the recess r1. The non-grounding member X2 attached to the recess r1 can suppress the intrusion of the foreign matter into the recess Similarly, the grounding member X1 attached to the recess r1 can suppress the intrusion of the foreign matter into the recess r1.

On the other hand, the movement of the center of gravity of the head is facilitated in the second adjusting method shown in FIGS. 12A, 12B, and 12C. When the adjustment of the face angle and the movement of the center of gravity of the head are desired, the second adjusting method is preferable.

The following relationship A can be achieved by the second adjusting method. The relationship A can be produced also by the first adjusting method.

[Relationship A]: As the face angle is opened, the center of gravity of the head is positioned on the back side.

When the face is opened in impact, a slice is apt to be generated. Meanwhile, as the center of gravity of the head is positioned on the back side, the angle of the center of gravity is apt to be large. As is well known, when the angle of the center of gravity is large, the face is apt to be returned in impact. When the relationship A is realized, an excessive slice can be suppressed by the canceling between the face angle and the angle of the center of gravity.

Although not shown in the drawings, one grounding member X1 and one non-grounding member X2 may be used as a third adjusting method. In this case, the grounding member X1 is attached to one attaching portion r1. Furthermore, the non-grounding member X2 may be attached to any of the other two attaching portions r1. Therefore, the attached position of the non-grounding member X2 can be selected. The position of the center of gravity of the head can be adjusted by the selection.

The grounding member X1 and the non-grounding member X2 provided on the sole s4 can lower the center of gravity of the head. The head having a low center of gravity can realize a high launch angle and small backspin. The head having a low center of gravity can contribute to an increase in a flight distance.

Thus, in the embodiment, the weight distribution of the head can be adjusted in addition to the adjustment of the face angle. Therefore, the above synergistic effect can be exhibited.

The number of the grounding members X1 is defined as N1; the number of the non-grounding members X2 is defined as N2; and the number of the attaching portions r1 is defined as N3. In the above embodiment, N3 is equal to the sum of N1 and N2 (N1+N2). For this reason, various adjustments are enabled by changing the positions of the grounding member X1 and the non-grounding member X2. N1 may be equal to or greater than 2. A plurality of grounding members X1 having different heights may be prepared. In this case, the face angle can be varied by changing the grounding members X1. (N1+N2) may be greater than N3. (N1+N2) may be less than N3.

In the above embodiment, each of the plurality of attaching portions r1 is a recess. Furthermore, as shown in FIG. 7, the plurality of recesses have the same planar view shape. Furthermore, the grounding member X1 and the non-grounding member X2 have the same planar view shape. All of the attaching portions r1 conform to all of the grounding member(s) X1 and the non-grounding members X2. The grounding members X1 can be attached to all of the attaching portions r1. The non-grounding members X2 can be attached to all of the attaching portions r1. For this reason, various adjustments are enabled by changing the positions of the grounding member X1 and the non-grounding member X2.

The positions of the plurality of attaching portions r1 can be independently set freely. In light of a sole shape and face angle adjustment, the position of each of the attaching portions r1 can be freely set. Therefore, this can correspond to a complicated sole shape, and can realize desired face angle adjustment.

The weight W1 of the grounding member X1 may be substantially equal to the weight W2 of the non-grounding member X2. In this case, the movement of the center of gravity of the head when the grounding member X1 is moved can be effectively suppressed. The term "substantially equal" means that the difference between the weights is within ±1 g. The difference between the weights W1 and W2 is more preferably equal to or less than 20%, still more preferably equal to or less than 10%, and yet still more preferably equal to or less than 5%.

The adjustable range of the face angle is preferably large. However, the excessively closed face angle and the excessively opened face angle are unnecessary. In light of them, the lower limit of the adjustable range of the face angle is preferably equal to or greater than 2 degrees, and more preferably equal to or greater than 3 degrees. The upper limit of the adjustable range is preferably equal to or less than 10 degrees, more preferably equal to or less than 8 degrees, and still more preferably equal to or less than 6 degrees. For example, when the maximum value of the face angle is +1 degree, and the minimum value of the face angle is −1 degree, the adjustable range of the face angle is 2 degrees.

A method for fixing the grounding member X1 and the non-grounding member X2 is not limited. In respect of fixation certainty, fixation caused by mechanical connection is preferable. An example of the mechanical connection is the above screw connection.

Another examples of the mechanical connection include an attaching/detaching mechanism described in Japanese Patent Application Laid-Open No. 2012-139403. In the attaching/detaching mechanism, a cavity body is attached to a head, and a weight is detachably attached to the cavity body. For example, a face angle can be varied by the size of the weight. For example, the projection height of the weight from a sole surface can be varied by changing the height of a head portion of the weight. The attaching/detaching mechanism has excellent convenience.

[Material of Grounding Member X1]

The material of the grounding member X1 is not limited. Preferable examples of the material include a metal, a resin, and a fiber-reinforced resin. In respect of a strength and durability, the metal is preferable. Examples of the metal include a titanium alloy, stainless steel, an aluminum alloy, a magnesium alloy, a tungsten-nickel alloy, and a tungsten alloy. Examples of the resin include an engineering plastic and a super-engineering plastic. Examples of the fiber-reinforced resin include CFRP (carbon fiber-reinforced plastic). When the movement of the center of gravity of the head is suppressed, a material having a small specific gravity is preferable. In this respect, the fiber-reinforced resin, the titanium alloy, the aluminum alloy, and the magnesium alloy are preferable, and the aluminum alloy is more preferable. When the movement of the center of gravity of the head is facilitated, a material having a large specific gravity and easily processed is preferable. In this respect, the stainless steel and the tungsten-nickel alloy are preferable.

[Material of Non-Grounding Member X2]

The material of the non-grounding member X2 is not limited. Preferable examples of the material include a metal, a resin, and a fiber-reinforced resin. In respect of a strength and durability, the metal is preferable. Examples of the metal include a titanium alloy, stainless steel, an aluminum alloy, a magnesium alloy, and a tungsten-nickel alloy. Examples of the resin include an engineering plastic and a super-engineering plastic. Examples of the fiber-reinforced resin include CFRP (carbon fiber-reinforced plastic). When the movement of the center of gravity of the head is suppressed, a material having a small specific gravity is preferable. In this respect, the fiber-reinforced resin, the titanium alloy, the aluminum alloy, and the magnesium alloy are preferable, and the aluminum alloy is more preferable. When the movement of the center of gravity of the head is facilitated, a material having a large specific gravity is preferable. In this respect, the stainless steel and the tungsten-nickel alloy are preferable.

A method for manufacturing the grounding member X1 is not limited. Examples of the method include forging, sintering, casting, die-casting, NC processing, press forming, and injection molding. A method for manufacturing the non-grounding member X2 is not limited. Examples of the method include forging, sintering, casting, die-casting, NC processing, press forming, and injection molding.

[Method for Measuring Face Angle]

In the measurement of the face angle, the golf club 2 is left at a specified lie angle on the level surface HP. The axis line s1 of the shaft is disposed in a plane VP perpendicular to the level surface HP. The shaft 6 can move in the direction of the axis line s1 in a state where the lie angle is held, and the shaft 6 is rotatably supported around the axis line s1. The sole s4 is grounded on the level surface HP so that the head 4 is most stable while the support of the shaft 6 is maintained. The state where the head 4 is most stable is also referred to as a face angle measurement state. In the face angle measurement state, the face angle is measured. In FIG. 4, a straight line LF shown by a chain double-dashed line is a tangent line brought into contact with the face f4 in a center point FC of the face f4. The tangent line LF is parallel to the level surface HP. The face angle is measured based on the tangent line LF. When a line of intersection between the level surface HP and the plane VP is defined as LK, an angle θ between the line of intersection LK and the tangent line LP is the face angle. The angle θ is measured in the plan view. The face angle can be measured by a measuring apparatus shown in FIG. 14 in Japanese Patent Application Laid-Open No. 2004-267460. In Japanese Patent Application Laid-Open No. 2004-267460, the face angle in the present application is referred to as a hook angle.

The center point FC of the face f4 is defined as the center of a figure of the face f4 in the plan view.

If the grounding member X1 is attached to the attaching portion, the non-grounding member X2 attached to another attaching portion is not grounded on the level surface HP in the face angle measurement state.

In the case of a driver (No. 1 wood), the specified lie angle is usually 56 degrees or greater and 60 degrees or less. The real loft angle of the driver is usually 8 degrees or greater and 13 degrees or less. The club length of the driver is usually 43 inches or greater and 48 inches or less. The club length is measured based on the golf rule of "lc. Length" in "1. Clubs" of "Appendix II. Design of Clubs" specified by R&A (Royal and Ancient Golf club of Saint Andrews).

In the present application, the direction of the line of intersection LK is defined as a toe-heel direction. The direction perpendicular to the toe-heel direction and parallel to the level surface HP is defined as a face-back direction.

In the present application, a plus or minus sign is applied to the value of the face angle (see FIG. 4). When the face f4 is closed to the line of intersection LK, the face angle is described as a plus value. When the face f4 is opened to the line of intersection LK, the face angle is described as a minus value. In the state shown in FIG. 4, the face f4 is opened, and the face angle is a minus value.

EXAMPLES

Hereinafter, the effects of the present invention will be clarified by Examples. However, the present invention should not be interpreted in a limited way based on the description of the Examples.

Example 1

The same golf club as the golf club 2 described above was produced. First, a first member (face member) was obtained by pressing a rolling material. A second member (body) was obtained by lost-wax precision on casting. The second member had a sole having three attaching portions (recesses) formed therein. A screw hole was formed in the bottom face of each of these three attaching portions. The first member and the second member were welded, to obtain a head body. A titanium alloy was used as the material of the head body.

Separately, one grounding member and two non-grounding members were produced. An aluminum alloy was used as the material of these members.

A shaft, a sleeve, a washer, a screw, and a grip were produced by a well-known method. An aluminum alloy was used as the material of the sleeve. A titanium alloy was used as the material of the screw. The sleeve was bonded to the tip portion of the shaft, to obtain a shaft sleeve member. The shaft sleeve member was screwed to the head. The grip was attached to the back end of the shaft, to obtain the golf club. The specified lie angle of the head was 58 degrees.

The one grounding member and the two non-grounding members were screwed to each of the recesses of the head, which resulted in a state shown in FIG. 5. As shown in FIGS. 11A, 11B and 11C, a face angle was adjusted by varying the disposal of the grounding member and the non-grounding member. As shown in FIG. 11A, when the grounding member was disposed on the most back side, the face angle was −2 degrees. As shown in FIG. 11B, when the grounding member was disposed in art intermediate position, the face angle was 0 degree. As shown in FIG. 11C, when the grounding member was disposed on the most face side, the face angle was +2 degrees.

In Example 1, the weight W1 of the grounding member X1 was 2 g, and the weights W2 of the two non-grounding members X2 were 2 g, respectively. That is, the weight W1 and the weight W2 were made equal to each other. As a result, the position of a center of gravity of the head was fixed regardless of the disposing order of the grounding member X1 and the two non-grounding members X2.

Next, the face angle was adjusted by using only the grounding member without using the non-grounding member. As shown in FIGS. 12A to 12C, the face angle was adjusted by varying the disposal of the grounding member. As shown in FIG. 12A, when the grounding member was disposed on the most back side, the face angle was −2 degrees. As shown in FIG. 12B, when the grounding member was disposed in the intermediate position, the face angle was 0 degree. As shown in FIG. 12C, when the grounding member was disposed on the most face side, the face angle was +2 degrees.

In Example 1, it was possible not to use both the grounding member and the non-grounding member. In Example 1, it was possible to use only the non-grounding member. In these embodiments, the grounding member was not used, and thereby a novel fourth face angle was obtained.

Example 2

Figure 13:
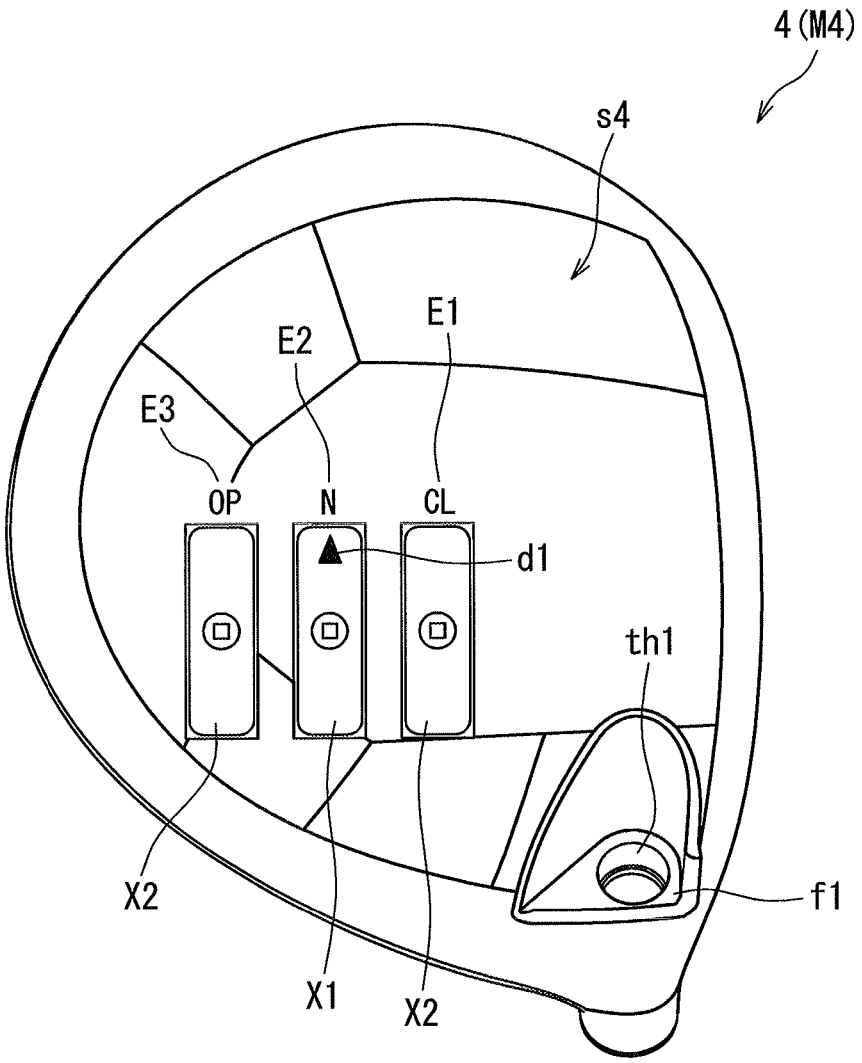
FIG. 13 is a bottom view of a head according to a second embodiment.

A golf club of Example 2 was obtained in the same manner as in Example 1 except that indications were provided on a grounding member and a sole s4. FIG. 13 was a bottom view of a head according to Example 2. In Example 2, an indication portion d1 was provided on a grounding member X1. The indication portion d1 of the embodiment has a substantially triangle shape. The position of the grounding member X1 was easily discriminated by the indication portion d1. The grounding member X1 was easily distinguished from a non-grounding member X2 by the indication portion d1.

Meanwhile, sole indication portions E1, E2, and E3 were provided on a sole s4 of a head body M4. The sole indication portion E1 (first sole indication portion) was provided in a position corresponding to a first attaching portion r11. The sole indication portion E2 (second sole indication portion) was provided in a position corresponding to a second attaching portion r12. The sole indication portion E3 (third sole indication portion) was provided in a position corresponding to a third attaching portion r13. Thus, the sole indication portions E1, E2, and E3 were provided in the positions corresponding to the respective attaching portions r1.

The sole indication portions E1, E2, and E3 were indications capable of showing the state of the face angle. A character "CL" was employed as the sole indication portion E1. This stands for "CLOSED". A character "N" was employed as the sole indication portion E2. This stands for "NEUTRAL". A character "OP" was employed as the sole indication portion E3. This stands for "OPENED". The face angle was shown by the positional relationship between these sole indication portions E1, E2, and E3 and the indication portion d1. Therefore, the face angle was easily grasped.

Thus, in Examples, the face angle is easily adjusted. The position of the center of gravity or the like can also be adjusted. The positions of the attaching portions and the shape of the grounding member X1 can be freely set. Therefore, the present invention can also deal with a sole having a complicated shape, and has a high degree of freedom for adjusting the face angle. The advantages of the present invention are apparent.

The invention described above can be applied to all golf club heads.

The description hereinabove is merely for an illustrative example, and various modifications can be made in the scope not to depart from the principles of the present invention.

What is claimed is:

1. A golf club comprising:

a head; and a shaft, wherein the head comprises a sole, a face, at least one grounding member, and at least one non-grounding member;

the sole comprises a plurality of attaching portions;

the grounding member is detachably attached to any of the plurality of attaching portions;

the face angle is varied depending on an attached position of the grounding member;

the non-grounding member is attachable and detachable to/from each of the attaching portions; and an attached position of the non-grounding member does not influence the face angle.

2. The golf club according to claim 1, wherein the non-grounding member is attached to the attaching portion to which the grounding member is not attached.

3. The golf club according to claim 1, wherein each of the plurality of attaching portions is a recess; the recess can regulate rotation of the grounding member; and the recess can regulate rotation of the non-grounding member.

4. The golf club according to claim 1, wherein a weight of the grounding member is substantially equal to a weight of the non-grounding member.

5. The golf club according to claim 1, wherein a center of gravity of the head moves with movement of the grounding member; and the golf club can be adjusted so that a center of gravity of the head moves to a back side as the face angle is opened.

6. The golf club according to claim 1, further comprising a screw, wherein the grounding member is detachably attached by the screw.

7. The golf club according to claim 1, further comprising two screws, wherein the number of the non-grounding members is two; and each of the non-grounding members is detachably attached by each of the screws.

8. The golf club according to claim 1, wherein the plurality of attaching portions are disposed in different positions in a face-back direction.

9. The golf club according to claim 1, wherein each of the plurality of attaching portions is a recess; a height of the grounding member is greater than a depth of the recess; and a height of the non-grounding member is equal to or less than the depth of the recess.

10. The golf club according to claim 1, wherein the non-grounding member comprises a hollow portion.

11. The golf club according to claim 1, wherein the grounding member comprises a hollow portion.

12. The golf club according to claim 1, wherein the grounding member comprises a grounding surface; and the grounding surface is a curved surface convexed to the outside of the head.

13. The golf club according to claim 1, wherein the non-grounding member can suppress movement of a center of gravity of the head caused by adjustment of the face angle.

14. The golf club according to claim 1, wherein the number of the attaching portions is equal to or greater than three; the grounding member is attached to at least one of the attaching portions; and the non-grounding member can be selectively attached to any of the other attaching portions.

15. The golf club according to claim 1, wherein if the number of the grounding members is defined as N1, the number of the non-grounding members is defined as N2, and the number of the attaching portions is defined as N3, N3 is equal to the sum of N1 and N2.

16. The golf club according to claim 1, wherein the number of the grounding members is equal to or greater than two; and the golf club comprises the grounding members having heights different from each other.

17. The golf club according to claim 1, wherein each of the plurality of attaching portions is a recess; the plurality of recesses have the same planar view shape; and the grounding member and the non-grounding member have the same planar view shape.

18. The golf club according to claim 1, wherein the golf club is a driver.

19. The golf club according to claim 1, wherein a first attaching portion, a second attaching portion, and a third attaching portion are provided as the attaching portions;

a first sole indication portion is provided in a position corresponding to the first attaching portion;

a second sole indication portion is provided in a position corresponding to the second attaching portion;

a third sole indication portion is provided in a position corresponding to the third attaching portion; and the first sole indication portion, the second sole indication portion, and the third sole indication portion are indications capable of showing a state of the face angle.

20. A golf club comprising:

a head; and a shaft, wherein the head comprises a sole, a face and at least one grounding member;

the sole comprises a plurality of attaching portions;

the grounding member is detachably attached to any of the plurality of attaching portions;

the face angle is varied depending on an attached position of the grounding member; and the plurality of attaching portions are disposed in different positions in a face-back direction.

* * * * *